US007364346B2

(12) United States Patent
Uhler et al.

(10) Patent No.: US 7,364,346 B2
(45) Date of Patent: Apr. 29, 2008

(54) LOW VOLTAGE TRACK LIGHTING ASSEMBLY AND SYSTEM

(75) Inventors: George J. Uhler, Wadsworth, OH (US); Thomas Trojan, Bedford, OH (US)

(73) Assignee: The L.D. Kichler Co., Cleveland, OH (US)

( * ) Notice: Subject to any disclaimer, the term of this patent is extended or adjusted under 35 U.S.C. 154(b) by 231 days.

(21) Appl. No.: 11/220,220

(22) Filed: Sep. 6, 2005

(65) Prior Publication Data

US 2007/0053209 A1 Mar. 8, 2007

(51) Int. Cl.
*F21V 21/005* (2006.01)
*F21V 21/008* (2006.01)

(52) U.S. Cl. ..... 362/648; 362/247; 362/391; 362/652

(58) Field of Classification Search ..... 362/648, 362/651–653, 655, 391, 219, 225, 241, 247, 362/249, 250, 404, 418, 657–659; 439/391, 439/427, 426, 419, 425, 398, 797, 811
See application file for complete search history.

(56) References Cited

U.S. PATENT DOCUMENTS 4,979,081 A * 12/1990 Leach et al. ..... 362/219
5,065,295 A * 11/1991 de la Haye et al. ..... 362/391
5,109,324 A * 4/1992 Ahroni ..... 362/249
5,672,000 A * 9/1997 Lin ..... 362/249
5,785,411 A * 7/1998 Komai et al. ..... 362/219
5,967,649 A 10/1999 Schlesinger
6,074,073 A * 6/2000 Huang ..... 362/653
6,345,902 B2 * 2/2002 Ohkohdo et al. ..... 362/549
6,435,696 B1 * 8/2002 Foottit ..... 362/219
6,802,626 B2 * 10/2004 Belfer et al. ..... 362/249
7,165,863 B1 * 1/2007 Thomas et al. ..... 362/219

OTHER PUBLICATIONS

Executed Declaration of Jim Jones Sep. 24, 2007.
Digital photographs (Photos B-1 to B-7) of a first known lighting assembly, 7 pgs., no date.
Digital photographs (Photos C-1 to C-5) of a second known lighting assembly, 5 pgs., no date.
Digital photographs (Photos D-1 to D-4) of a third known lighting assembly, 4 pgs., no date.

* cited by examiner

*Primary Examiner*—Y Quach Lee
*Assistant Examiner*—Leah S Lovell
(74) *Attorney, Agent, or Firm*—Calfee, Halter & Griswold LLP

(57) ABSTRACT

Various embodiments of lighting assemblies, lighting apparatus, and lighting systems are provided. The lighting assemblies, apparatus, and systems can have first and second contacts disposed to retain a bulb and to pierce an insulation layer on a conductor. The lighting assemblies, lighting apparatus, and lighting systems can be low voltage lighting assemblies and lighting systems. Methods of installing lighting systems are also provided.

38 Claims, 16 Drawing Sheets

FIG. 8
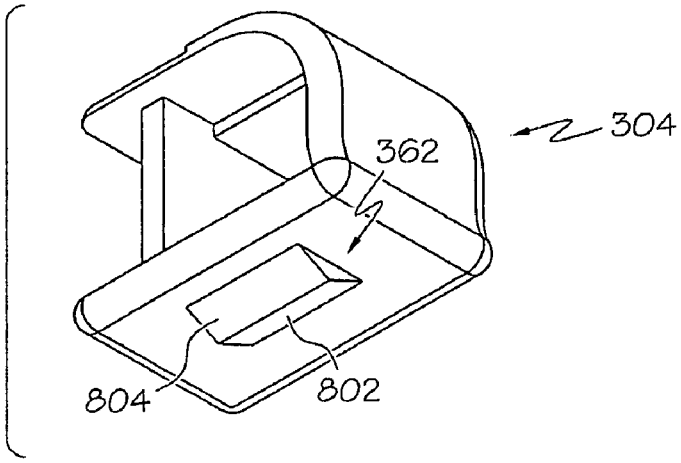
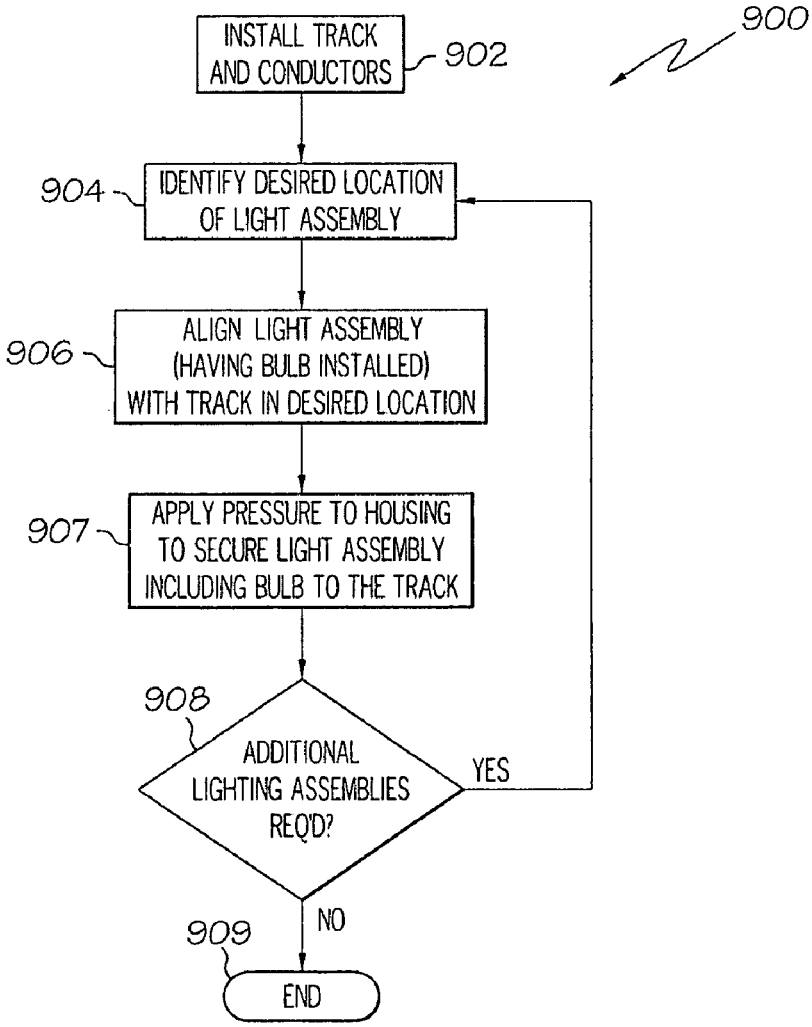
FIG. 9

LOW VOLTAGE TRACK LIGHTING ASSEMBLY AND SYSTEM

BACKGROUND

Low voltage lighting assemblies and lighting systems can be used for accent lighting, such as, for example, accent lighting in a kitchen accomplished by placing a lighting system on the bottom of one or more kitchen cabinets. Many of these lighting systems are supplied by the factory with the lighting assemblies pre-attached to the lighting system at set distances apart. A few lighting systems have lighting assemblies with insulation piercing tabs that allow them to be positioned after installation of the lighting system. Thus, a user may place the light assemblies only as required to accent desired areas. However, these lighting assemblies may be easily damaged, include spring tabs that may be overextended, and require that the light bulb be removed from the lighting assembly prior to installation on the lighting system. Thus, there remains a need in the art for additional lighting assemblies and systems.

SUMMARY

Various embodiments of lighting assemblies and lighting systems are provided. In one embodiment, a lighting assembly is provided. The lighting assembly comprises a bulb having a filament electrically connected with a first end cap and a second end cap; a first contact having (a) a piercing member for piercing an insulation layer on a first conductor and (b) a retention member for at least partially retaining the first end cap; a second contact having (a) a piercing member for piercing an insulation layer on a second conductor and (b) a retention member for at least partially retaining the second end cap; and a housing having one or more engaging members for connecting to a base. The housing at least partially retains the first contact member and the second contact member. The housing is disposed to receive applied pressure while the bulb is carried by the first and second end caps such that the housing can be connected to the base and such that the piercing members pierce the insulation layers, thereby placing the filament in electrical communication with the first and second conductors.

In other embodiments, low voltage lighting systems are provided. An exemplary low voltage lighting system comprises a first insulated conductor and second insulated conductor; one or more tracks having a recess for at least partially retaining the first and second insulated conductors; and a plurality of lamp assemblies. Each lamp assembly may comprise a housing having a connecting member for connecting to the one or more tracks; a bulb having a first cylindrical connector and a second cylindrical connector; a first contact having a retention member for electrically connecting to the first cylindrical connector and a spike for penetrating the insulation of the first conductor; and a second contact having a retention member for electrically connecting to the second cylindrical connector and a spike for penetrating the insulation of the second conductor. The bulb is at least partially retained by the housing member, and when the housing is connected to the one or more tracks, the bulb is in electrical contact with the conductors via the first and second contacts.

BRIEF DESCRIPTION OF THE DRAWINGS

In the accompanying drawings, which are incorporated into and constitute a part of this specification, embodiments of the invention are illustrated, which, together with a general description of the invention given above, and the detailed description given below, serve to exemplify principles of this invention, wherein:

FIG. 8 is a perspective view of another exemplary housing;

FIG. 9 is a flowchart schematically illustrating an exemplary methodology for installing a lighting system.

DETAILED DESCRIPTION OF THE INVENTION

Figure 1:
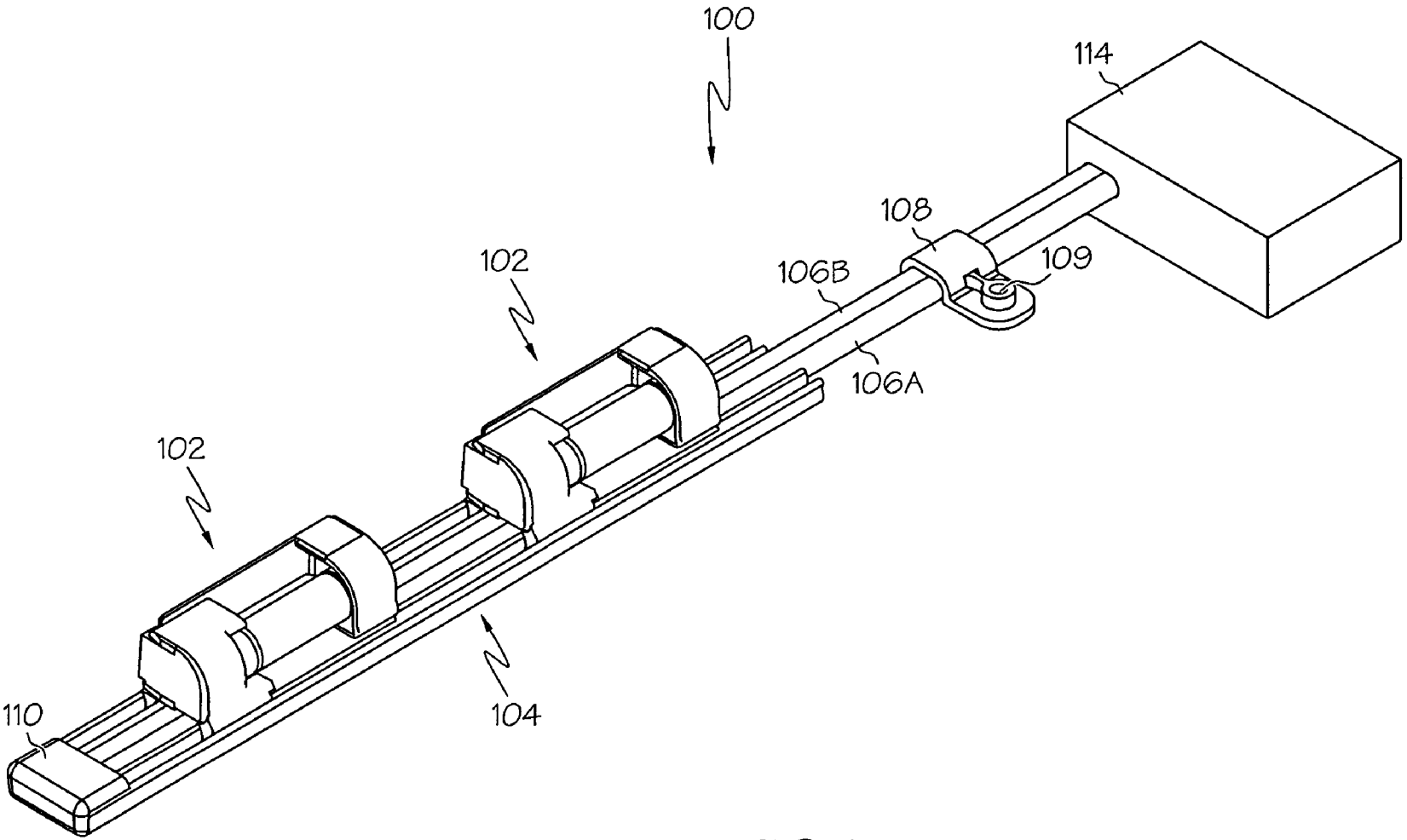
FIG. 1 illustrates an exemplary embodiment of a lighting system.
Figure 2:
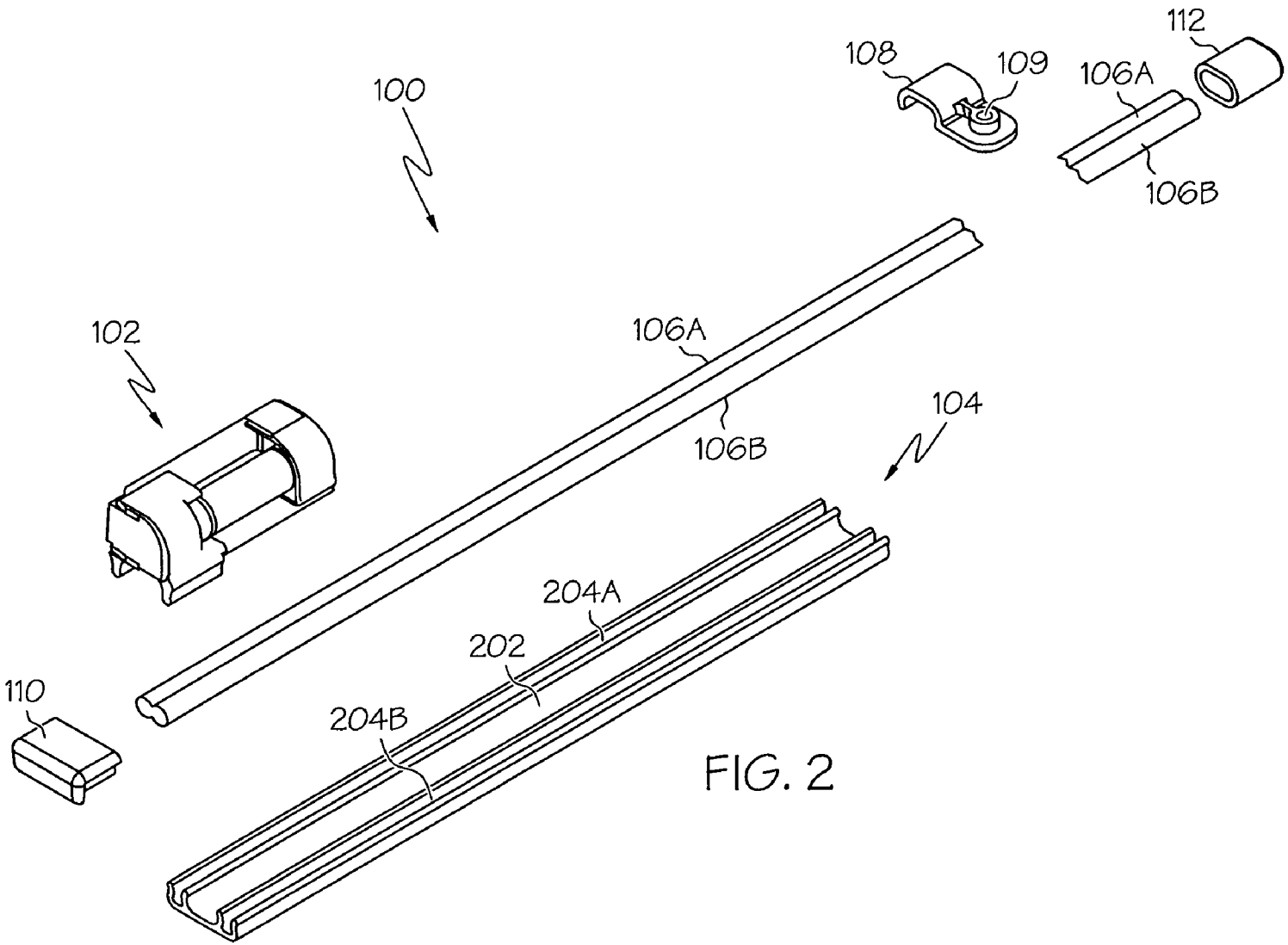
FIG. 2 illustrates an exemplary embodiment of selected components of the lighting system of FIG. 1.

FIGS. 1 and 2 illustrate an exemplary embodiment of a lighting system 100. The exemplary lighting system 100 includes at least one lighting assembly 102, a track 104 and insulated electrical conductors 106A, 106B. In one embodiment, insulated conductors 106A, 106B are insulated 10 gauge multistrand wires. In addition, lighting system 100 may include a transformer 114, one or more cable grips 108 for securing the conductors to a surface, and/or one or more track caps 110 to cap exposed conductors terminating at the end of a track portion.

The primary of transformer 114 is connected to a power source (not shown) to provide power to lighting system 100. The transformer steps down the voltage of the power source to a low voltage suitable for a low voltage lighting system, such as, for example, 12 volts. The secondary of the transformer is connected to insulated conductors 106A, 106B. A switch (not shown) for turning on/off lighting system 100 may be placed in series with either the primary, or secondary of the transformer 114.

Referring to FIGS. 1 and 2, track 104 includes at least one recess 202 for at least partially retaining insulated conductors 106A, 106B. In addition, track 104 may include a first groove 204A and a second groove 204B to connect with one or more engaging members, such as, for example, one or more projecting members on lighting assembly 102, discussed in more detail below. Track cap 110 includes one or more projecting members (not shown), which may be the same as those of lighting assembly 102, for securing track cap 110 to track 104. Track 104 may be any suitable length track and may extend along a substantial portion of the length of insulated conductors 106A, 106B. Optionally, one or shorter track segments may be used in selected areas where accent lighting is desired. Still optionally, track 104 may be relatively short and act as a base for as little as one lighting assembly 102.

In areas where the track 104 is not used, cable grips 108 may be used to secure the insulated conductors 106A, 106B to a surface, e.g., with a fastener such as a screw (not shown), extending through opening 109 into a surface. Insulated conductors 106A, 106B may have additional conductors spliced, or electrically connected to them to form one or more "tee" connections (FIGS. 10-17) allowing a plurality of lighting segments to be fed from a single transformer 114. The system 100 may also include one or more cable caps 112, which have an opening large enough to accept and cap exposed conductor ends.

Figures 3A, 3B:
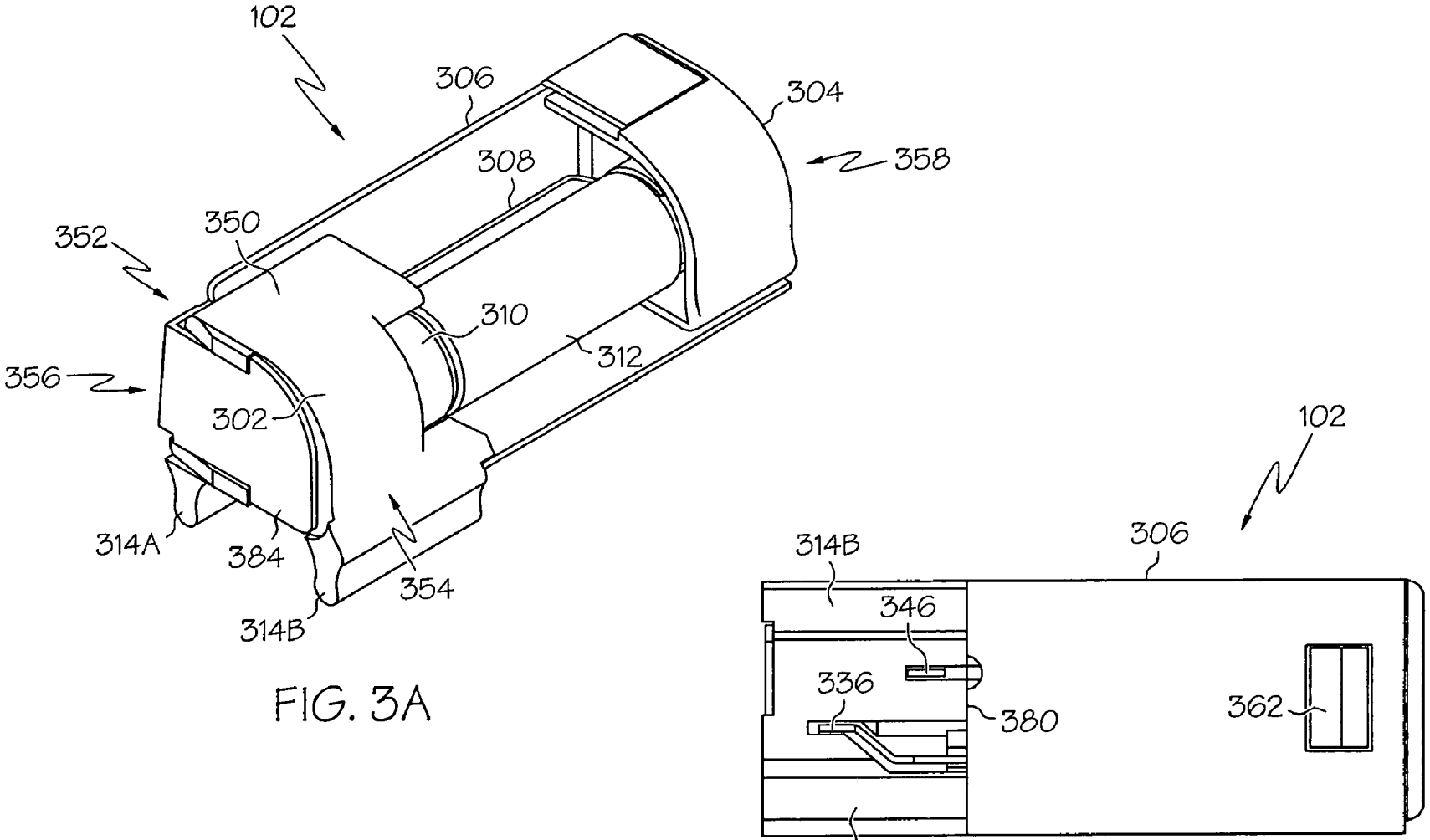
FIG. 3A is a perspective view of an exemplary embodiment of a lighting assembly.
FIG. 3B is a plan view of the exemplary lighting assembly of FIG. 3A.
Figure 3C:
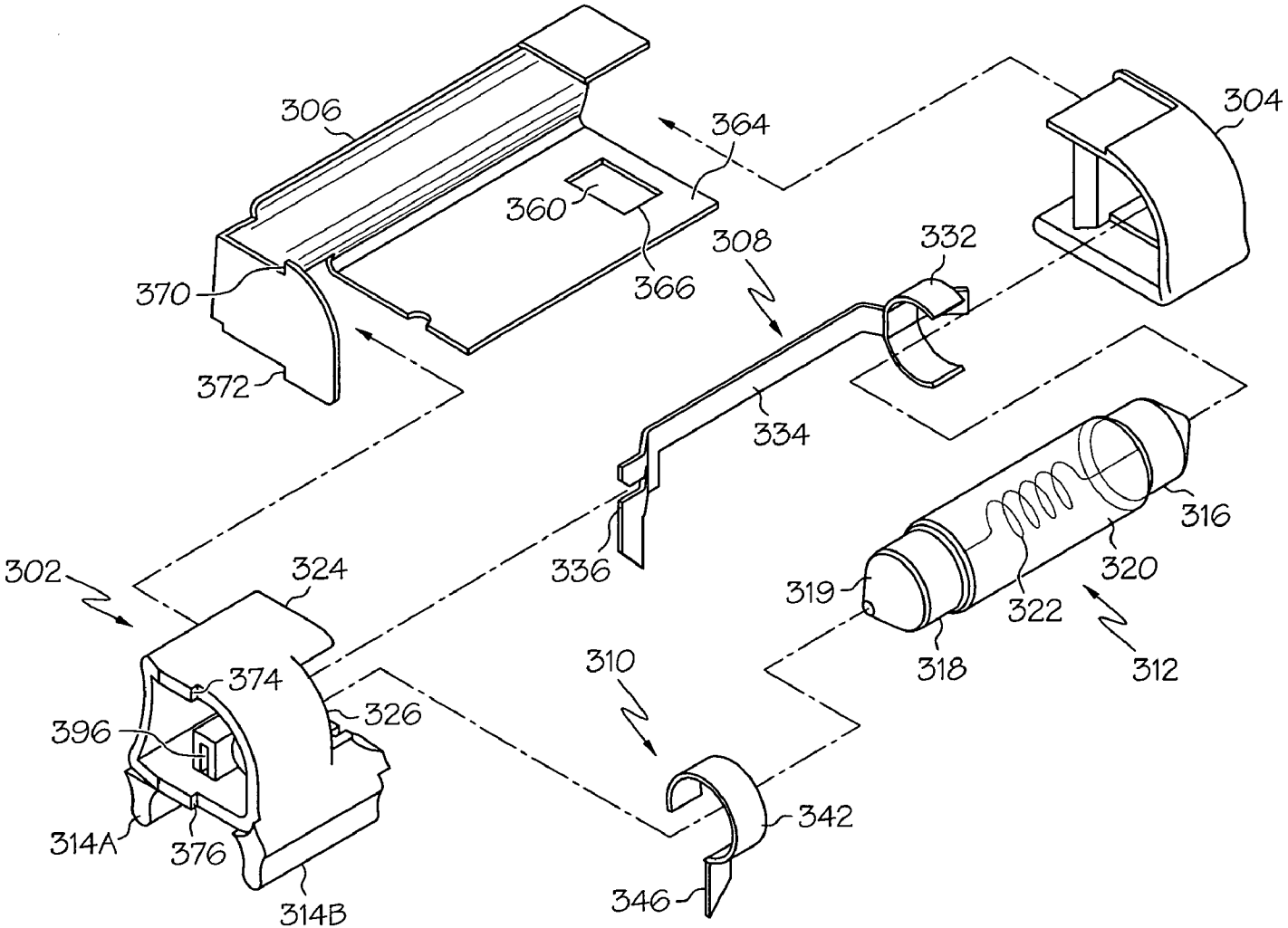
FIG. 3C is an exploded view of the exemplary embodiment shown in FIG. 3A.

FIGS. 3A-3C illustrate an exemplary embodiment of a lighting assembly 102. Exemplary lighting assembly 102 includes a housing 302, an optional end cover 304, an optional reflector 306, a first conductor 308 (also referred to herein as first contact 308), a second conductor 310 (also referred to herein as second contact 310), and a bulb 312. In this exemplary embodiment, these parts are configured to cooperate and secure to each other to form the lighting assembly 102. FIG. 3C provides an exploded view of the exemplary lighting assembly 102. Bulb 312 includes a glass cylinder 320, which may enclose a filament 322 (or some other source of illumination, e.g., a gas). The filament 322 (or other illumination source) is electrically connected to a first end cap 316 and a second end cap 318. In addition, the end caps 316, 318 typically seal the end of the glass cylinder 320. It will be understood that any suitable type of bulb may be used in accordance with the teaching of the present inventions. For example, festoon bulbs may be used.

First contact 308 may be made of any suitable electrically conductive material (e.g., bronze or copper or steel, which may be coated with another metal, such as tin) and includes a bulb retention member 332. Bulb retention member 332 is configured to at least partially retain first end cap 316 of bulb 312 such that an electrical connection between the first end cap 316 and first contact 308 is formed. The bulb retention member 332 may be any suitable member that secures to the end cap 316. For example, the retention member 332 can be a clip made of a resilient material that may be expanded slightly to fit over first end cap 316 such that the clip securely grips the first end cap 316. The retention member 332 may be a suitable sleeve or a clamping mechanism. In one embodiment, retention member 332 slides over first end cap 316. The first contact 308 has a piercing member 336 disposed proximate the end opposite of the first retention member 332. Piercing member 336 is disposed such that at least a portion thereof can pierce the insulation layer of a conductor. For example, piercing member 336 can include a sharp point or edge for piercing the insulation layer of a conductor, such as insulated conductors 106A, 106B. In another example, the piercing member 336 can be a spike or prong.

Second contact member 310 may also made of any electrically conductive material (e.g., bronze or copper or steel, which may be coated with another metal, such as tin) and also includes a bulb retention member 342 and a piercing member 346, as described above in connection with first contact member 308. Second contact member 310 can be configured the same or similarly as first contact member 308. It will be understood that first and second contact members 308, 310 can be made of a single piece or multiple pieces joined together or multiple pieces otherwise electrically connected to each other.

In the exemplary embodiment shown, first conductor 308 includes optional extension member 334. Extension member 334 is disposed such that piercing member 336 of the first conductor 308 may be located proximate the piercing member 346 of the second conductor 310. For example, extension member 334 can be disposed such that piercing member 336 is disposed at an end distant from bulb retention member 332. Thus, in an embodiment, piercing members 336, 346 are located near the same end of bulb 312 at housing 302. Thus, exerting pressure on a relatively small area of housing 302 (e.g., pressure applied by a thumb) causes both piercing members 336, 346 to pierce the insulation on their respective insulated conductors during installation.

Housing 302 may include a recess 324 for receiving piercing end 336 of first contact 308. Housing 302 may also include a recess 326 for receiving at least a portion of second contact 310 and optionally second end cap 318. Thus, housing 302 may be configured to at least partially retain first contact 308, second contact 310, and second end cap 318. At least a portion of piercing members 336, 346 extend below a portion of housing 302. In addition, the housing 302 includes one or more engaging members (two such engaging members 314A, 314B are shown) for connecting or otherwise securing the housing 302 to a base or track 104. When securing lighting assembly 102 to the base or track 104 by applying downward pressure (downward in the orientation of FIGS. 1, 3A, and 6A-6D) to housing 302, pressure is applied to piercing members 336, 346 thereby causing piercing members 336, 346 to pierce the insulation layer of insulated conductors 106A, 106B. In addition, the downwardly exerted pressure causes the engaging members 314A, 314B to engage with the corresponding grooves 204A, 204B in the track 104 (FIG. 2) thereby releasably securing the lighting assembly 102 to the track 104.

Exemplary housing 302 is shown disposed to receive applied pressure such that the 302 housing can be connected or releasably secure to the base or track 104. Thus, housing 302 has means for receiving applied pressure. The housing 302 shown includes an upper surface 350 (FIG. 3A) (i.e., a surface substantially perpendicular to the direction needed to pierce conductors 106A, 106B, which here may be parallel to a surface supporting conductors 106A, 106B) and/or opposing side walls 352, 354 that are disposed to receive applied pressure. In another example, the housing end 356 and the opposing end cap surface 358 are disposed to receive applied pressure. In other examples, the housing 302 may include, for example, extensions, tabs, recesses, projections or protrusions disposed to receive applied pressure. These may all be considered to be exemplary means for receiving applied pressure during installation. The housing 302 being disposed to receive applied pressure is one method of enabling lighting assembly 102 to be connected to track 104 with the bulb 312 already installed in the lighting assembly 102. For example, because the surface 350 is positioned substantially above (in the orientation of FIGS. 1, 3A, and 6A-6D) both piercing members 336, 346 and engaging members 314A, 314B, and laterally offset from the bulb 312, downward pressure may be exerted on upper surface 350 with the bulb 312 in place to (i) cause piercing members 336, 346 to pierce insulated conductors 106A, 106B (thereby placing the bulb in circuit communication with the insulated conductors 106A, 106B to illuminate bulb 312) and also (ii) secure lighting assembly 102 to track 104. More specifically, applying downward pressure to upper surface 350 places the bulb 312 in electrical connection with the insulated conductors 106A, 106B by piercing the insulation and contacting the wire conductors. In addition, the pressure causes the engaging members 314, 314B to secure to track 104. Lighting assembly 102 may also be gripped by opposing side walls 352 and 354 to exert pressure to light assembly 102 to connect it to track 104. In an embodiment, lighting assembly 102 may be gripped by housing end 356 and opposing end cap surface 358 to apply the pressure.

In the embodiment shown, an optional end cover 304 is provided. In this exemplary embodiment, end cover 304 at least partially encloses the first end cap 316 of the bulb 312 and at least partially encloses retention member 332. End cover 304 may be held in place by an optional reflector 306. Reflector 306 may be made of any material that has a reflective surface, such as metal (e.g., 1008/1010 steel that is 0.024" thick), or optionally plastic with a reflective coating. In another example, end cover 304 may be held in place with a non-reflective member (not shown) or may be connectable to the housing member 302. In the exemplary embodiment shown, the reflector 306 has an opening 360 into which a projection 362 (also shown in FIG. 8) of end cover 304 extends to help secure the reflector 306 to the end cover 304. The reflector 306 may be secured to the housing 302 via interlocking surfaces of the reflector 306 and the end cover 304. More specifically, in the embodiment shown, stepped portions 370, 372 of reflector 306 are held by corresponding stepped portions 374, 376 of housing 302. Additionally, in the embodiment shown, an edge 380 of reflector 306 abuts engaging members 314A, 314B to help secure the reflector 306 to the end cover 304.

In this embodiment, the end cover 304 optionally can be removed from the reflector 306 to permit the bulb 312 to be changed by flexing or bending an end 364 of the reflector 306 far enough that an edge 366 of opening 360 clears the projection 362 of end cover 304, permitting the end cover 304 to be removed. The bulb 312 can be changed and the unit reassembled by removing the end caps 316, 318 from their respective bulb retention members 332, 342, providing a new bulb 312, connecting end caps 316, 318 to their respective bulb retention members 332, 342, and sliding the end cover 304 back in place so the projection 362 of end cover 304 snaps into opening 360 of reflector 306. Similarly, the housing 302 can optionally be removed from the reflector 306 by flexing or bending a free end 384 of the reflector 306 far enough that the stepped portions 370, 372 of reflector 306 clear the stepped portions 374, 376 of housing 302, permitting the housing 302 to be removed from the reflector.

Figure 4A:
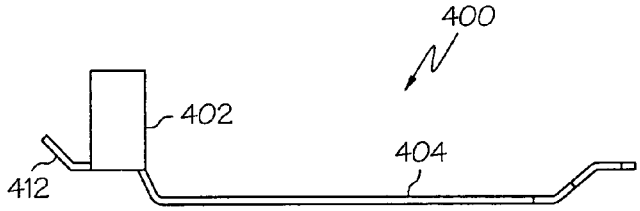
FIGS. 4A, 4B, and 4C are various views of an exemplary embodiment of a first contact.
Figure 4C:
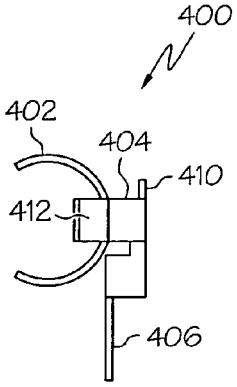
Figure 4B:
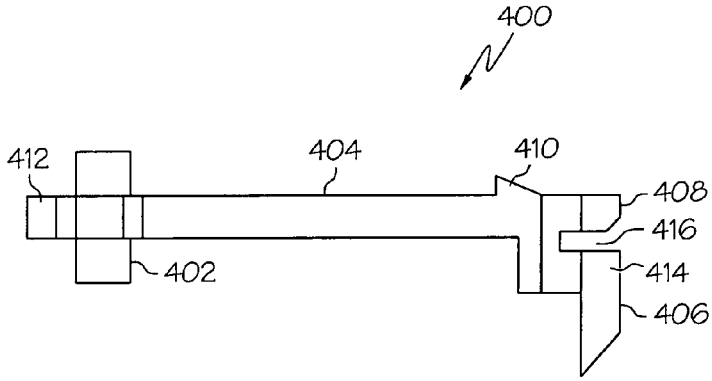

FIGS. 4A, 4B and 4C illustrate an exemplary embodiment of a contact 400, which may be used as first contact 308. Contact 400 includes a bulb retention member 402 located near one end. As described above, bulb retention member 402 can be any retention member and is configured to securely and releasably connect to a bulb (not shown). Contact 400 includes piercing member 406 located near the end opposite the retention member 402, and extension member 404 located between retention member 402 and piercing member 406. In addition contact 400 includes projection 408, which may be inserted into an opening 390 (FIGS. 6A and 6B) in housing 302. An upper portion 414 of piercing member 406 is one means for engaging with a housing member, such as housing 302. For example, upper portion 414 of piercing member 406 in this embodiment is configured to allow pressure applied to the housing 302 to be transferred to the upper portion 414 of piercing member 406, so that downward pressure on the housing 302 causes the piercing member 406 to pierce the insulation on an insulated conductor. In addition, the space 416 between piercing member 406 and projection 408 may have a portion 392 (FIGS. 6A and 6B) of the housing 302 extending therethrough allowing pressure to be transferred through the housing to the bottom of projection 408 through an additional contact point. Contact 400 is made of an electrically conductive material, such as, e.g., 0.020" thick phosphor bronze plated with a thin (e.g., 0.00008-0.00025") layer of tin, and can me made of a single piece or multiple pieces joined together or multiple pieces otherwise electrically connected to each other. Contact 400 may have an optional barb 410 to help secure contact 400 to housing 302, e.g., by contacting a surface 394 (FIG. 6A) of housing 302. Contact 400 may also have an optional projection 412 to facilitate releasing bulb retention member 402 from the bulb 312 if the bulb 312 is changed. The upper portion 414 of piercing member 406 may be accepted by a slot 396 (FIGS. 6A and 6B) in housing 302.

Figure 5B:
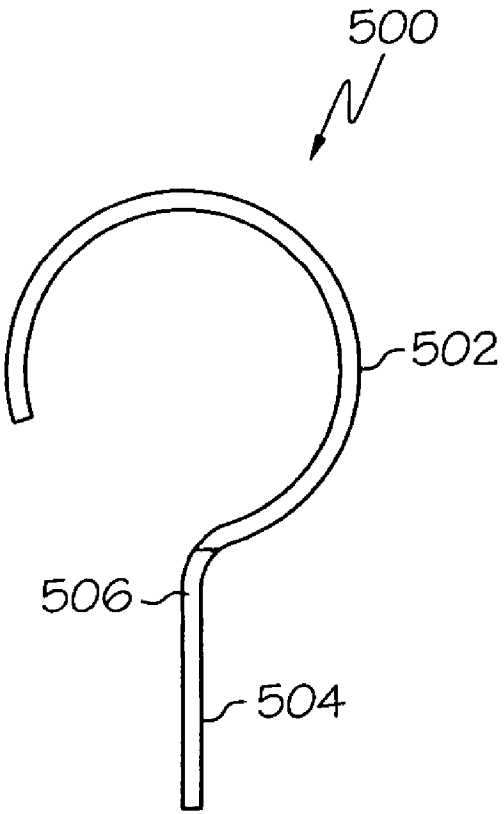
FIGS. 5A and 5B are various views of another exemplary embodiment of a contact.
Figure 5A:
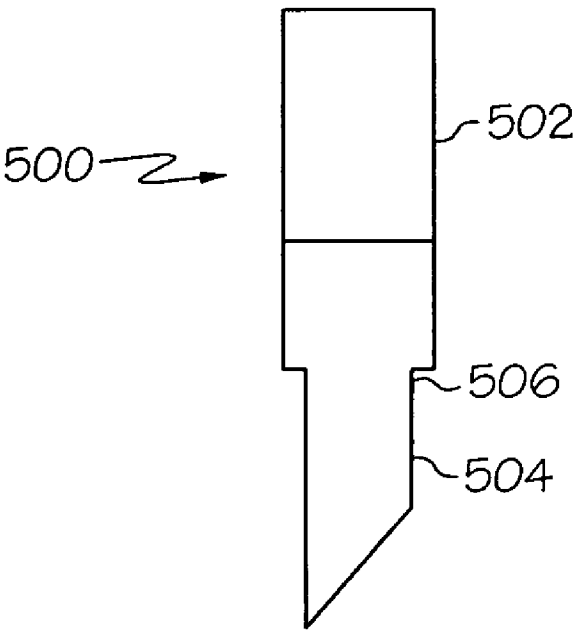

FIGS. 5A and 5B illustrate an exemplary embodiment of another contact member 500, which may be used as second contact 310. Contact member 500 includes a retention member 502 connected to a piercing member 504, an upper portion of which is accepted by a slot. The contact member 500 also includes a recess 506. Recess 506 provides an improved fit between the housing and the contact member. It will be understood that contact 500 may be manufactured with or without recess 506. Other types of recesses or extension members may be employed with contact 500 to provide additional surface area to contact the housing for retention purposes or for aiding in the transmission of force applied to the housing to the piercing member 504. Contact 500 is made of an electrically conductive material, such as, e.g., 0.020" thick phosphor bronze plated with a thin (e.g., 0.00008-0.00025") layer of tin, and can me made of a single piece or multiple pieces joined together or multiple pieces otherwise electrically connected to each other. The upper portion of piercing member 504 may be accepted by a slot 398 (FIG. 6B) in housing 302.

Figure 6A:
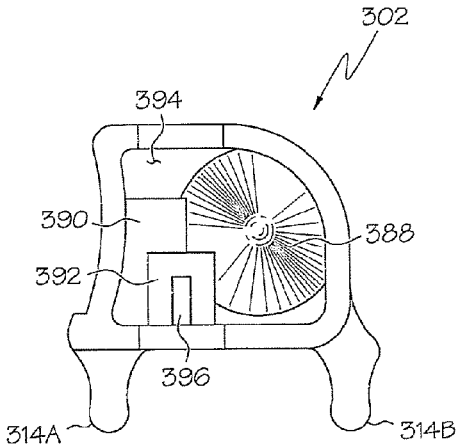
FIGS. 6A and 6B are elevational views of opposite ends of an exemplary housing.
Figure 6B:
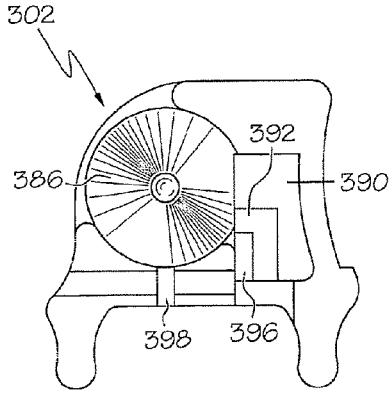
Figure 6C:
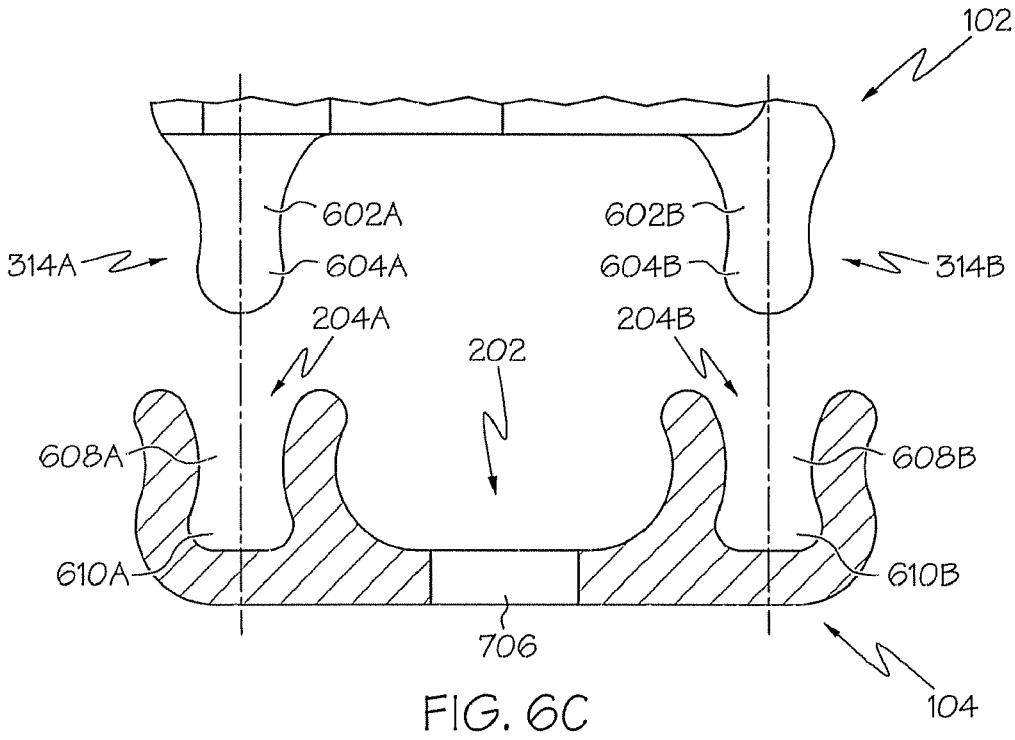
FIGS. 6C and 6D are elevational views showing the exemplary housing with an exemplary track.
Figure 6D:
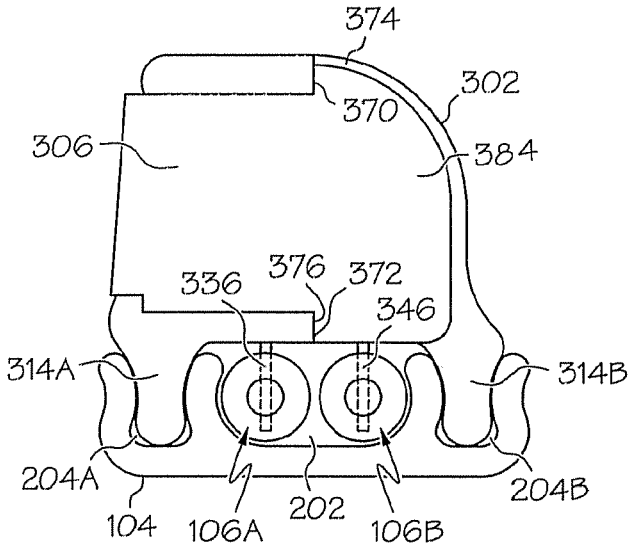

FIGS. 6A and 6B illustrate an exemplary embodiment of housing 302. Some of the structures in the housing 302 were discussed above in the context of the electrical contacts. The exemplary housing 302 shown also has a generally conical opening 386 (forming a generally conical projection 388) that accepts a generally conical end 319 of bulb 312 (FIG. 3C) to help hold the bulb 312 in place when the module is assembled. Housing 302 may also include one or more engaging members, such as projecting members 314A, 314B. Projecting members 314A, 314B are shaped to form a friction connection with grooves 204A, 204B. The friction connection provides a secure releasable connection of the light assembly 102 to the base or track 104. Any suitable engaging member for securing the lightning assembly 102 to the base 104 is considered as included herein, such as, for example, one or more tabs, slots, snapping mechanisms, and/or hooking mechanisms. Furthermore, the engaging members may be engaged within the track 104, such as, for example, the grooves 204A, 204B in the track 104 or on/over the outside of the track 104. The engaging members may grip tabs, or slots, or extensions in or on the track member 104. More specifically, as shown in FIGS. 6C and 6D, in the embodiment shown, the engaging members 314A, 314B of assembly 102 may have a relatively narrow portion 602A, 602B and a relatively wider portion 604A, 604B that are held in place by respective narrow portions 608A, 608B and respective relatively wider portions 610A, 610B of track 104. During insertion, e.g., by applying pressure to surface 350 of housing 302, the narrow portions 608A, 608B of track 104 flex to accommodate relatively wider portions 604A, 604B of assembly 102 and flex back to retain the engaging members 314A, 314B in the channels 204A, 204B.

Figure 7B:
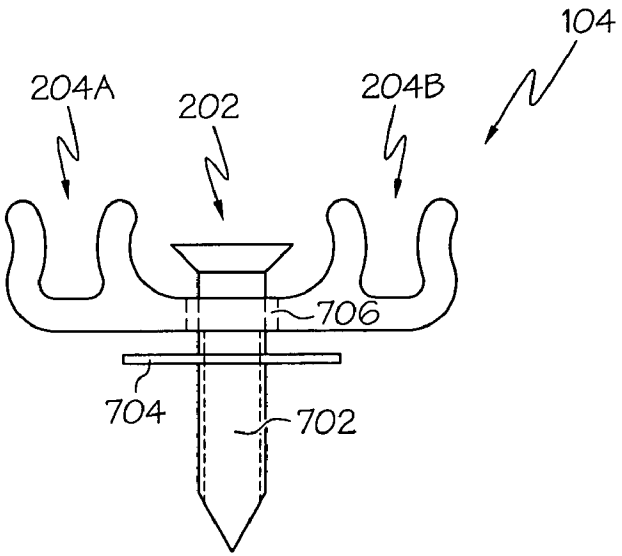
FIGS. 7A-7F show various views of exemplary tracks.
Figure 7A:
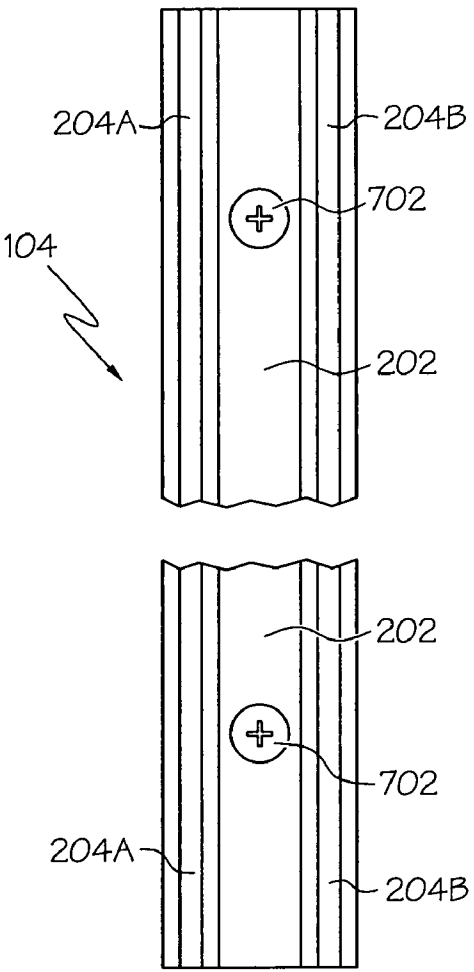
Figure 7C:
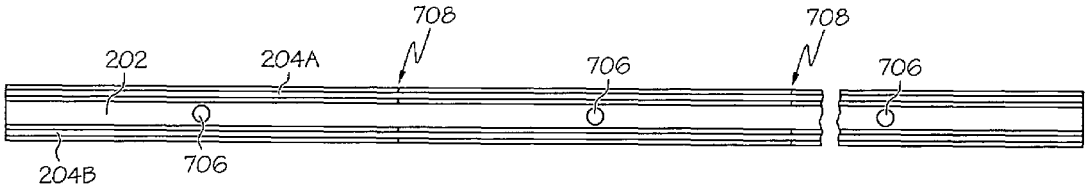
Figure 7D:
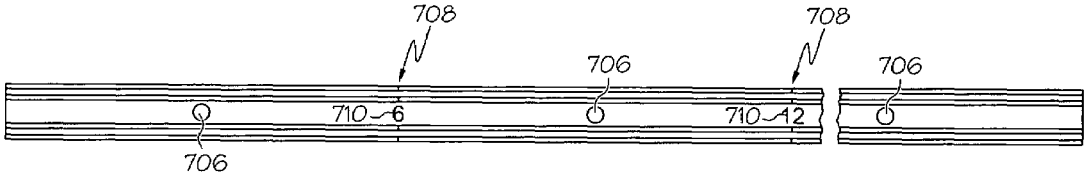
Figure 7E:
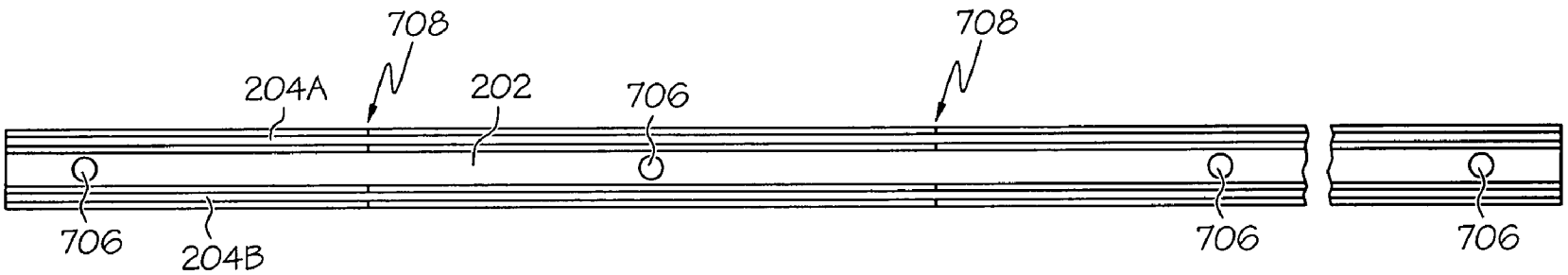
Figure 7F:
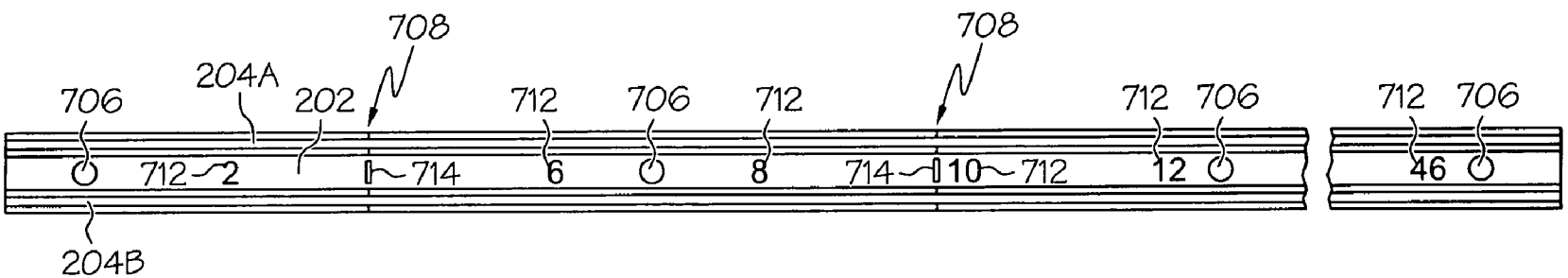

FIGS. 7A-7F show various configurations for track 104. As shown in FIGS. 7A and 7B, the track 104 may be secured to a surface via fasteners in track openings, e.g., captive screws 702 held in place in openings 706 in the track 104 via retainer washers 704. As shown in FIGS. 7C-7F, the track 104 may be scored 708 at various locations to facilitate breaking the track 104 by hand at various desired lengths. The track may be made from any suitable material, e.g., General Electric polyphenylene oxide (PPHOX) 731. Track made from this material may be scored 0.020" wide and 0.046" deep. Such scores 708 may be placed at suitable distances, e.g., every six inches. As shown in FIGS. 7D and 7F, the track may have distance indicia 710 associated with the scores 708 to show the distance from one end of the track that the score 708 is located. The track 104 may also have distance indicia 712 unassociated with any particular score 708 to show the distance from one end of the track. Additionally, or in the alternative, the track may have indicia 714 associated with the scores 708 to show the location of a particular score 708 without also showing any particular track distance. Distance indicia may be placed at various distances, such as every 6" (FIG. 7D) or every 2" where there is not also a track opening 706 or non-distance related track indicia 714 located (FIG. 7F). Additionally, the track openings 706 may also be placed at various distances.

Various configurations, combinations and permutations of the above exemplary embodiments may be employed. One exemplary embodiment (not shown) includes two housing members, such as, for example, two housing members 302, a bulb 312, and two contact members, such as, for example, contact member 500. In this exemplary embodiment, one housing member 302 is located on each end of the bulb 312. Each housing member 302 at least partially encloses a contact member 500 and an end of the bulb 312. Housing members 302 include one or more engaging members for connection to a base or track 104. In addition, optionally, a reflector 306 is connected between the two housing members.

FIG. 8 shows a bottom-left-front view of exemplary end cover 304. FIG. 8 shows an optional exemplary projection 362 accepted by opening 360 of reflector 306. Exemplary projection 362 is shaped as two adjacent planar ramps 802, 804, which facilitates removable assembly of the end cover 304 to the reflector 306, as discussed above.

FIG. 9 illustrates an exemplary methodology 900 setting forth novel aspects of an exemplary lighting method. The blocks shown represent functions, actions or events performed therein. It will be appreciated that many methodologies involve dynamic and flexible processes such that many of the functions, actions, or events can be performed in other sequences different than the one shown.

More specifically, FIG. 9 illustrates an exemplary methodology 900 of installing a lighting system and light assemblies. The lighting assemblies include a light bulb so that once the lighting assembly is secured to the track a user need not thereafter attempt to install a light bulb in the lighting assembly. The methodology 900 begins at block 902 where the track and conductors are installed. The track may be installed along the entire length of the conductors, or merely in select areas where accent lighting is desired. In an embodiment, the track is secured with screws and the insulated conductors are retained by a groove in the track. In areas where there is no track, the cable may be secured to the surface using cable grips. At block 904 a desired location of a lighting assembly is selected. The lighting assembly, including the light bulb, is aligned with the track at the selected location at block 906. At block 907, pressure is applied to the housing, or to the means to apply pressure, to secure the light assembly (including the light bulb) to the track and place the bulb in electrical communication with the insulated conductors. The lighting assemblies may be as shown in the other figures and as described above. At block 908, a determination is made as to whether additional lighting assemblies are required. If additional lighting assemblies are desired the methodology loops back to block 904 where additional locations are identified. If no additional lighting assembles are desired, the methodology ends at block 909.

Figure 10:
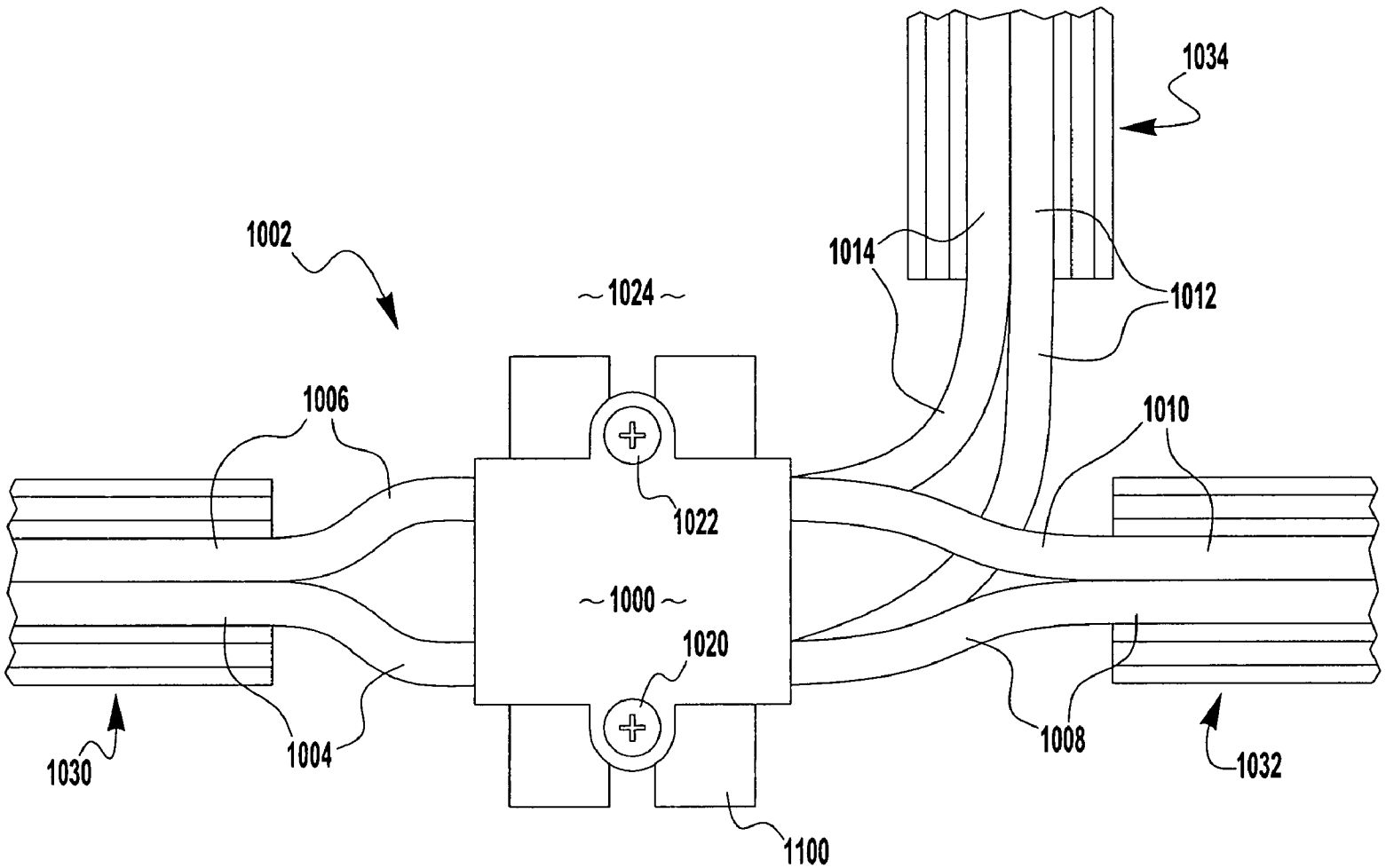
FIG. 10 is a top plan view of an exemplary terminal block in an exemplary installation.

Referring now to FIGS. 10-17, an exemplary terminal block 1000 is shown. FIG. 10 shows the terminal block 1000 in an exemplary terminal block installation 1002. The terminal block 1000 permits a single pair of electrical conductors, e.g., a pair of conductors from a transformer, to feed a plurality of parallel lighting segments by permitting additional electrical conductors to be spliced to them, forming a multi-tap connection. In the exemplary terminal block 1000 shown, there is one input connection and up to three output connections. Exemplary installation 1002 comprises a first pair of conductors 1004, 1006, which conductors supply electrical energy, e.g., from a transformer. Conductors 1004, 1006 are electrically connected and mechanically connected to terminal block 1000, with the terminal block 1000 insulating the first conductor 1004 from the second conductor 1006. Terminal block 1000 is shown carrying a second pair of conductors 1008, 1010 and a third pair of conductors 1012, 1014, and may also carry a fourth pair of electrical conductors (not shown). Terminal block 1000 electrically connects conductors 1008 and 1012 to conductor 1004 and electrically connects conductors 1010 and 1014 to conductor 1006, as set forth in more detail below. In this exemplary installation 1002, optional fasteners 1020, 1022 fasten terminal block 1000 to a surface 1024. Also, any one or more of the conductor pairs 1004, 1006; 1008, 1010; and 1012, 1014 may be carried by track capable of accepting a lighting module 102. More specifically, the first pair of conductors 1004, 1006 are shown as being carried by a length of track 1030 capable of accepting a lighting module 102, the second pair of conductors 1008, 1010 are shown as being carried by a length of track 1032 capable of accepting a lighting module 102, and the third pair of conductors 1012, 1014 are shown as being carried by a length of track 1034 capable of accepting a lighting module 102. The track may be the same as track 104 shown and described above.

Figure 11:
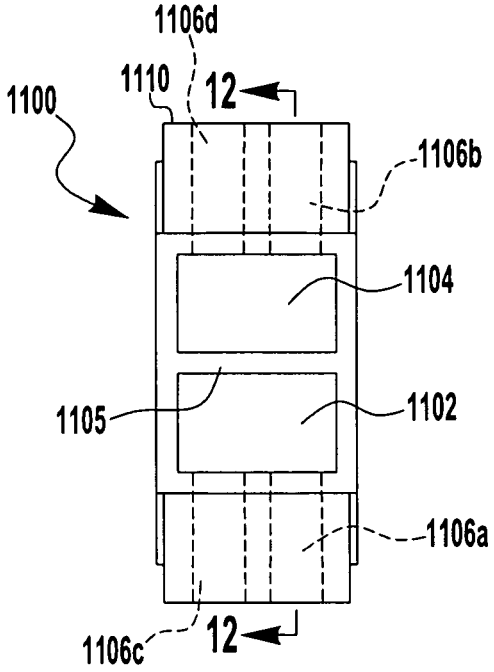
FIG. 11 is a side elevational view of the exemplary terminal block housing of the terminal block of FIG. 10.
Figure 12:
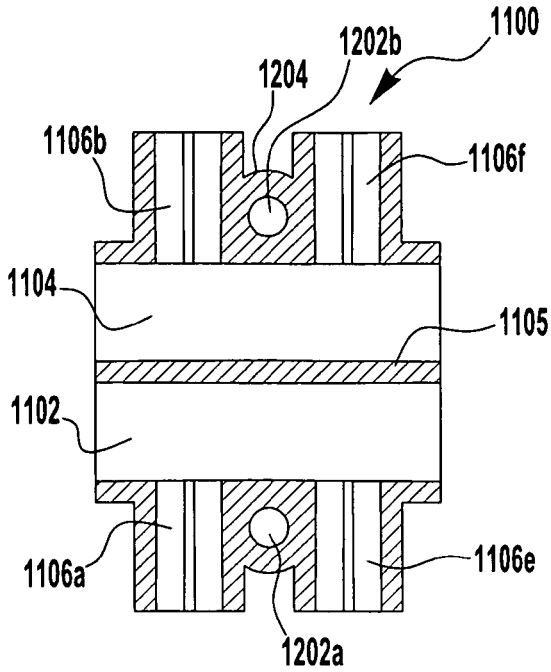
FIG. 12 is a top sectional view of the exemplary terminal block of FIG. 10 taken along section line 12-12 in FIG. 11.
Figure 13:
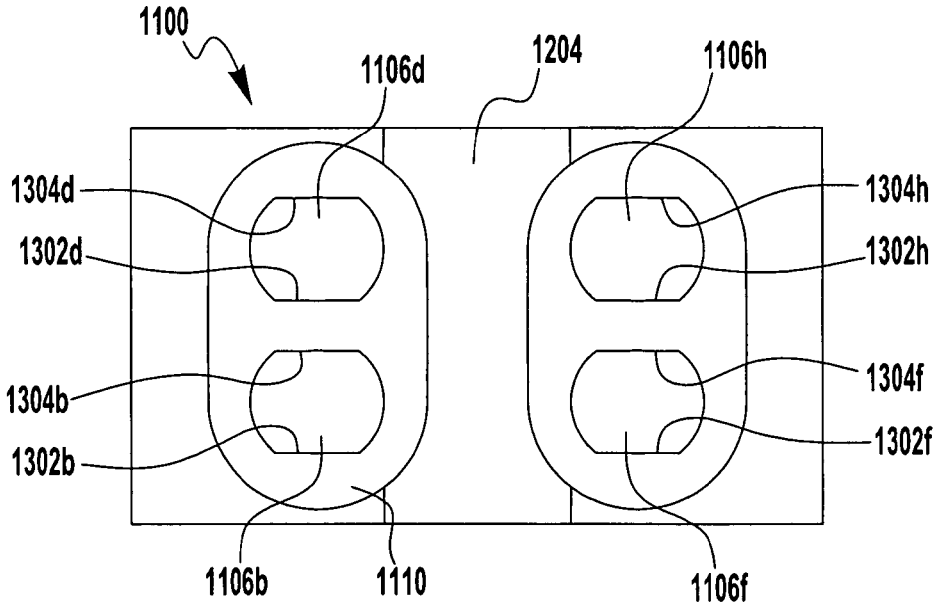
FIG. 13 is a front elevational view of the exemplary terminal block of FIG. 10.

FIGS. 11-13 show a terminal block housing 1100 of the exemplary terminal block 1000. FIG. 12 is a sectional view taken along line 12-12 in FIG. 11. The housing 1100 has openings 1102, 1104 separated by an insulating wall 1105 and accepting conductor pairs 1004, 1006; 1008, 1010; and

1012, 1014 (shown in FIG. 10) that are electrically and mechanically held by terminal block 1000. Exemplary terminal block housing 1100 shown also has a plurality of openings 1106 (this embodiment includes eight such openings 1106*a*-1106*h*), which accept fasteners (1410 shown in FIG. 14) used to secure the conductors to the terminal block 1000 (opening 1106*g* is hidden behind opening 1106*c* in FIG. 11 and hidden behind opening 1106*e* in FIG. 12). Openings 1106*a*-1106*h* extend from outside the housing 1100 through and into one of the openings 1102 and 1104. Each of the exemplary openings 1106 is shown as comprising a non-circular cross-section having flat portions 1302, 1304, which can be spaced close enough to captively retain fasteners 1410 in place. Exemplary terminal block housing 1100 also includes openings 1202*a*, 1202*b* through which fasteners 1020, 1022 fasten terminal block 1000 to surface 1024 (shown in FIG. 10). Openings 1202*a*, 1202*b* each contain an annular ring (not shown) for retaining fasteners 1020, 1022 until installation to a mounting surface.

Figure 14:
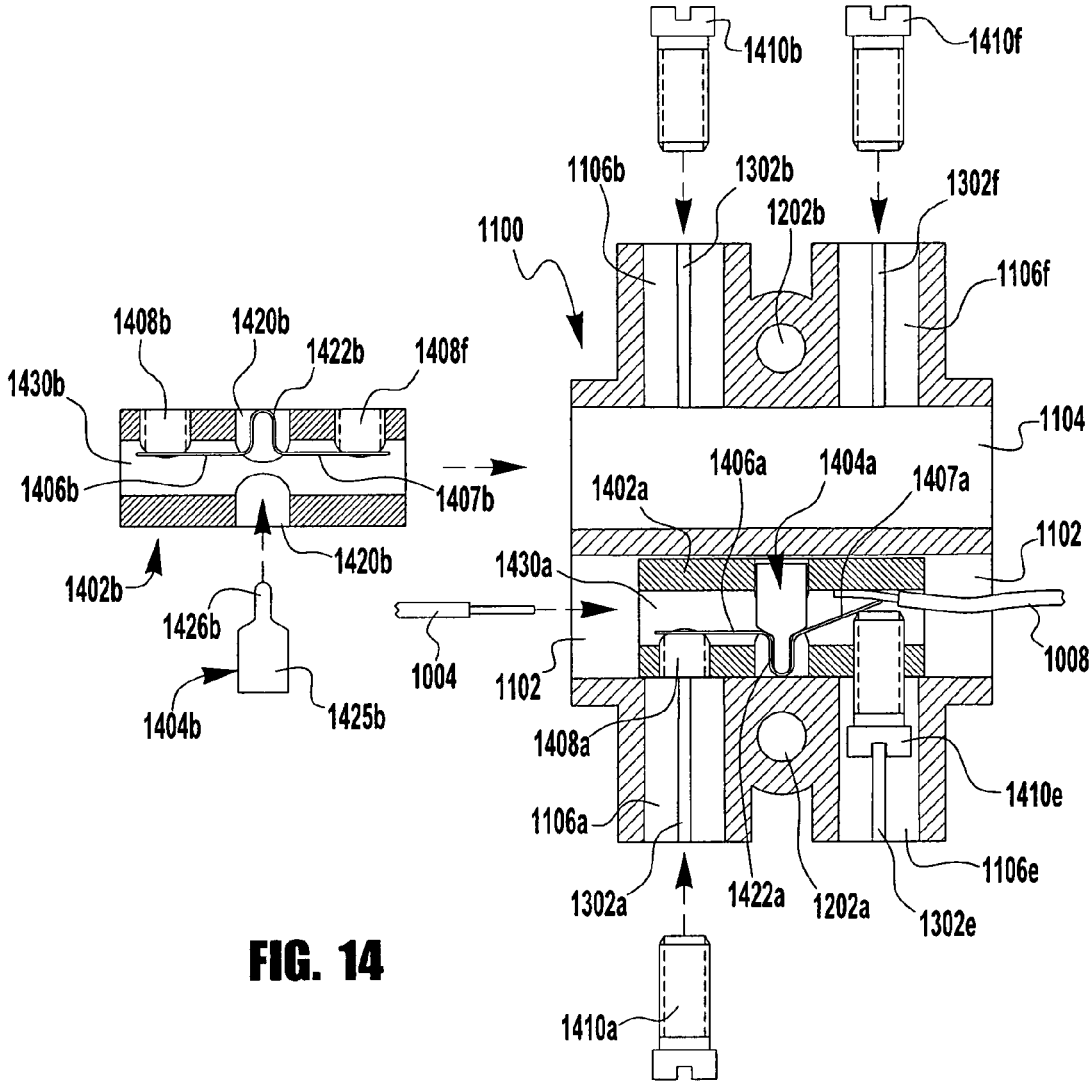
FIG. 14 is an exploded sectional view of the exemplary terminal block of FIG. 10.
Figure 15A:
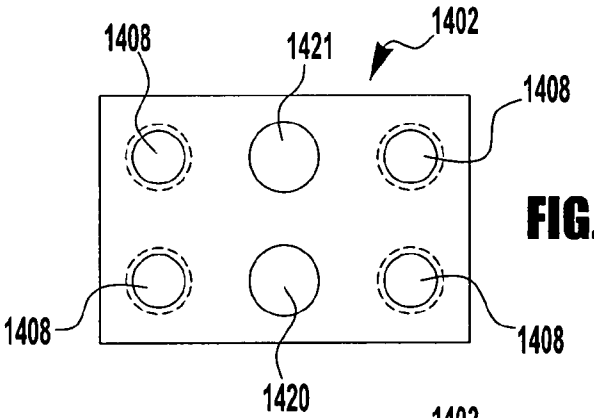
FIGS. 15A, 15B, and 15C are three orthogonal views of an exemplary wire connection of the exemplary terminal block of FIG. 10.
Figure 15B:
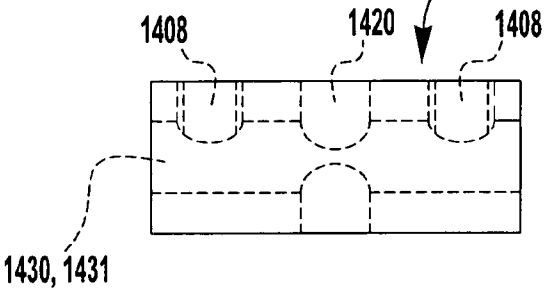
Figure 15C:
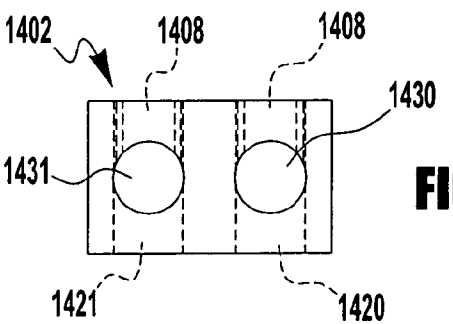
Figure 16:
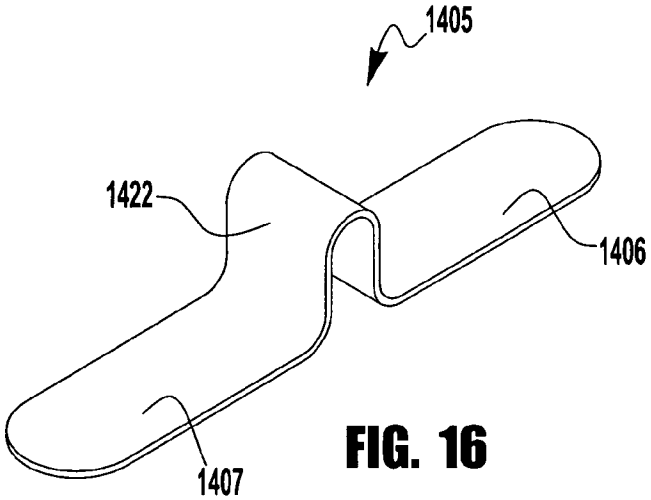
FIG. 16 is an isometric view of an exemplary wire protector flap of the exemplary terminal block of FIG. 10.
Figure 17:
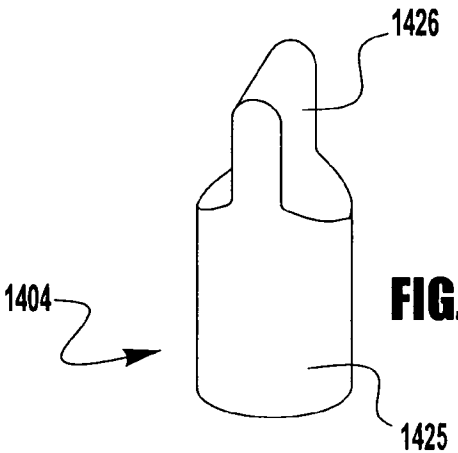
FIG. 17 is an isometric view of an exemplary wire flap retainer of the exemplary terminal block of FIG. 10.

FIG. 14 is a partially exploded sectional view of the exemplary terminal block 1000. Openings 1102, 1104 of housing 1100 each accept a wire connector 1402*a*, 1402*b*. Wire connectors 1402*a*, 1402*b* each carry a wire protector flap 1405 held in place by a wire flap retainer 1404. Each exemplary wire protector flap 1405 shown has a first end 1406 and a second end 1407. Wire connectors 1402*a*, 1402*b* each also have a plurality of threaded openings 1408 (in FIG. 15A four such openings are shown in each wire connector 1402), each of which threaded opening 1408 accepts a fastener 1410, which fastener 1410 also extends through a respective opening 1106 in the terminal block housing 1100. Wire connectors 1402*a*, 1402*b* each also have an opening 1420*a*, 1420*b* one portion of which accepts a bend 1422*a*, 1422*b* in a respective wire protector flap 1405 and another portion of which accepts a body 1425 of respective wire flap retainer 1404. Wire connectors 1402*a*, 1402*b* each also have at least one opening (two openings 1430, 1431 are shown) at least one end of which accepts a conductor, e.g., conductors 1004, 1008, to be held in place with pressure from a fastener 1410 via an end 1406, 1407 of wire protector flap 1405. FIGS. 15A-15C show additional views of the exemplary wire connectors 1402 shown. Similarly, FIGS. 16 and 17 show additional details of wire protector flap 1405 and wire flap retainer 1404.

While the present invention has been illustrated by the description of embodiments thereof, and while the embodiments have been described in some detail, it is not the intention of the applicant to restrict or in any way limit the scope of the appended claims to such detail. Additional advantages and modifications will readily appear to those skilled in the art, for example, providing one or more housings configured to at least partially retain a plurality of bulbs. Therefore, the invention in its broader aspects is not limited to the specific details, representative apparatus and methods, and illustrative examples shown and described. Accordingly, departures may be made from such details without departing from the spirit or scope of the applicant's general inventive concept.

We claim:

1. A lighting assembly comprising:

a bulb having a filament electrically connected with a first end cap and a second end cap;

a first contact having (a) a first piercing member for piercing an insulation layer on a first conductor and (b) a first retention member for at least partially retaining the first end cap;

a second contact having (a) a second piercing member for piercing an insulation layer on a second conductor and (b) a second retention member for at least partially retaining the second end cap; and a housing having one or more engaging members for connecting to a base; and wherein the housing at least partially retains the first contact and the second contact, and wherein the housing includes an upper surface at least partially covering the bulb, the upper surface being aligned with the first and second piercing members, such that the upper surface is disposed to receive applied pressure while the bulb is carried by the first and second contacts to direct the first and second piercing members to pierce the insulation layers, thereby placing the filament in electrical communication with the first and second conductors.

2. The lighting assembly of claim 1 wherein the housing further comprises a housing surface substantially parallel to a surface supporting the conductors when the lighting assembly is connected to the base, and wherein the housing surface substantially parallel to the surface supporting the conductors is disposed to receive the applied pressure.

3. The lighting assembly of claim 1 wherein the housing further comprises a pair of opposing surfaces, and wherein the pair of opposing surfaces is disposed to receive the applied pressure.

4. The lighting assembly of claim 1 further comprising a surface on an end cap and a surface on the housing, wherein the surface on the end cap and the surface on the housing are disposed to receive the applied pressure.

5. The lighting assembly of claim 1 further comprising a base for receiving the one or more engaging members to connect the housing to the base.

6. The lighting assembly of claim 5 wherein the base is an elongated track having a recess for at least partially retaining the first and second connectors.

7. The lighting assembly of claim 5 wherein the base comprises a channel for at least partially retaining the first and second conductors.

8. The lighting assembly of claim 7 wherein the base comprises one or more additional channels for receiving the one or more engaging members.

9. The lighting assembly of claim 1 wherein the one or more engaging members comprise one or more projecting members.

10. The lighting assembly of claim 1 wherein the one or more engaging members comprise one or more mating members.

11. The lighting assembly of claim 1 further comprising a reflector connected to the housing.

12. The lighting assembly of claim 11 further comprising an end cover for at least partially retaining one of the first and second end caps.

13. The lighting assembly of claim 12 wherein the end cover is connected to the reflector.

14. The lighting assembly of claim 1 wherein the retention member comprises a clip.

15. The lighting assembly of claim 1 wherein the retention member comprises a sleeve.

16. The lighting assembly of claim 1 wherein the first contact includes an extension member.

17. The lighting assembly of claim 16 wherein the piercing member of the first contact is disposed proximate to the piercing member of the second contact.

18. The lighting assembly of claim 1 wherein the piercing member of the first contact is disposed proximate to the piercing member of the second contact.

19. The lighting assembly of claim 1, wherein the housing upper surface is longitudinally aligned with the one or more engaging members, such that when the lighting assembly is aligned with a base confignred to retain the first and second conductors, applied pressure to the upper surface connects the one or more engaging members to the base contemporaneous with the first and second piercing members piercing the insulation layers of the first and second conductors.

20. A low voltage lighting system comprising:

a first insulated conductor and second insulated conductor;

one or more tracks having a recess for at least partially retaining the first and second insulated conductors; and a plurality of lamp assemblies, each lamp assembly comprising:

a) a housing having a connecting member for connecting to the one or more tracks;

b) a bulb having a first cylindrical connector and a second cylindrical connector;

c) a first contact having a retention member for electrically connecting to the first cylindrical connector and a spike for penetrating the insulation of the first conductor; and d) a second contact having a retention member for electrically connecting to the second cylindrical connector and a spike for penetrating the insulation of the second conductor;

wherein the bulb is at least partially retained by the housing member, and when the housing is connected to the one or more tracks, the bulb is in electrical contact with the conductors via the first and second contacts, further wherein the housing includes an upper surface at least partially covering the bulb, the upper surface being aligned with the first and second spikes, such that the upper surface is disposed to receive applied pressure to direct the first and second spikes to penetrate the insulation of the first and second conductors, thereby placing the bulb in electrical communication with the first and second conductors.

21. The lighting system of claim 20 further comprising a transformer connected to the first and second conductors for providing a low voltage to the lighting system.

22. The lighting system of claim 20 wherein the retention member is a sleeve.

23. The lighting system of claim 20 wherein the lamp assembly further comprises a reflector connected to the housing.

24. The lighting system of claim 23 further comprising an end piece connected to the reflector that at least partially retains an end of the bulb.

25. The lighting system of claim 20 further comprising a cable cap for covering an end of the first and second conductors.

26. The lighting system of claim 20 further comprising a track cap for covering an end of the track.

27. The lighting system of claim 26 wherein the track cap is configured to cover an end of the first and second conductors.

28. A lamp assembly comprising:

a housing having a pair of projecting members for connecting to a low voltage lighting system;

a first contact having (a) a clip proximate one end for connecting to a first bulb end of a bulb and (b) a spike proximate the other end for piercing the insulation of a conductor;

a second contact having (a) a clip proximate one end for connecting to a second bulb end, (b) an extension member, and (c) a spike proximate the other end for piercing the insulation of a conductor;

a reflector connected to the housing; and an end cover connected to the reflector;

wherein the housing encloses at least a portion of the first contact and a portion of the second contact and has a surface for receiving applied pressure when a bulb is connected to the low voltage lighting system;

wherein the end cover encloses at least a portion of the second bulb end and at least a portion of the second contact; and wherein the bulb is electrically connected between the first and second contacts.

29. The lamp assembly of claim 28 wherein the extension member extends in the direction of the length of the bulb.

30. The lamp assembly of claim 28 wherein the spikes extend below at least a portion of the housing.

31. The lamp assembly of claim 30 wherein the housing is proximate the end of the bulb connected to the first contact.

32. A lighting apparatus for a low voltage lighting system comprising:

a festoon bulb having first and second ends;

a first contact having means to retain the first end of the festoon bulb, and means to penetrate the insulation of a first conductor proximate the first end of the festoon bulb;

a second contact having means to retain the second end of the festoon bulb, and means to penetrate the insulation of a second conductor proximate the first end of the festoon bulb;

a housing having an engagement means for securing the housing to the low voltage lighting system; and the housing having pressure receiving means;

wherein, when the housing is secured to the low voltage lighting system, the festoon bulb is in electrical contact with the first and second conductors.

33. The lighting apparatus of claim 32, wherein the housing is configured to electrically and mechanically connect with the low voltage lighting system when the lighting apparatus is aligned with the low voltage lighting system and pressure is applied to the pressure receiving means.

34. The lighting assembly of claim 33 wherein the end cover is connected to the reflector.

35. A method of installing a low voltage lighting system having a plurality of lighting assemblies comprising:

providing a plurality of lighting assemblies having an associated housing and an associated light bulb installed therein;

installing a track and a pair of insulated electrical conductors;

identifying a desired location for a light assembly;

aligning one of the plurality of lighting assemblies having a light bulb installed therein with the track in the identified location; and applying pressure to a portion of the housing at least partially covering the installed light bulb to secure the lighting assembly to the track and to electrically connect the light bulb with the pair of insulated electrical conductors.

36. The method of claim 35, wherein applying pressure to a portion of the housing at least partially covering the installed light bulb comprises applying pressure to an end cover of the housing, the end cover enclosing at least a portion of a first end of the associated light bulb.

37. A lighting assembly comprising:

a bulb having a filament electrically connected with a first end cap and a second end cap;

a first contact having (a) a piercing member for piercing an insulation layer on a first conductor and (b) a retention member for at least partially retaining the first end cap;

a second contact having (a) a piercing member for piercing an insulation layer on a second conductor and (b) a retention member for at least partially retaining the second end cap; and a housing having one or more engaging members for connecting to a base;

a reflector connected to the housing; and an end cover for at least partially retaining one of the first and second end caps, wherein the housing at least partially retains the first contact member and the second contact member, and wherein the housing is disposed to receive applied pressure while the bulb is carried by the first and second end caps such that the housing can be connected to the base and such that the piercing members pierce the insulation layers, thereby placing the filament in electrical communication with the first and second conductors.

38. A low voltage lighting system comprising:

a first insulated conductor and second insulated conductor;

one or more tracks having a recess for at least partially retaining the first and second insulated conductors; and a plurality of lamp assemblies, each lamp assembly comprising:

a) a housing having a connecting member for connecting to the one or more tracks;

b) a bulb having a first cylindrical connector and a second cylindrical connector;

c) a first contact having a retention member for electrically connecting to the first cylindrical connector and a spike for penetrating the insulation of the first conductor;

d) a second contact having a retention member for electrically connecting to the second cylindrical connector and a spike for penetrating the insulation of the second conductor;

e) a reflector connected to the housing; and f) an end piece connected to the reflector that at least partially retains an end of the bulb, wherein the bulb is at least partially retained by the housing member, and when the housing is connected to the one or more tracks, the bulb is in electrical contact with the conductors via the first and second contacts.

* * * * *